United States Patent [19]

Bochan

[11] 4,207,760

[45] Jun. 17, 1980

[54] VANE ARRANGEMENT FOR CLOTHES WASHING MACHINE

[75] Inventor: John Bochan, Louisville, Ky.

[73] Assignee: General Electric Company, Louisville, Ky.

[21] Appl. No.: 947,238

[22] Filed: Sep. 29, 1978

[51] Int. Cl.[2] ..... D06F 13/02; D06F 21/06

[52] U.S. Cl. ..... 68/18 FA; 68/134; 68/174

[58] Field of Search ..... 68/18 FA, 133, 134, 68/152, 154, 171, 174

[56] References Cited

U.S. PATENT DOCUMENTS

| | | | |
|---|---|---|---|
| D. 209,773 | 1/1968 | Smith | D49/1 C |
| D. 237,004 | 9/1975 | Blake et al. | D49/1 C |
| 1,775,893 | 9/1930 | Dougherty | 68/133 |
| 2,096,683 | 10/1937 | Nelson | 68/134 |
| 2,105,774 | 1/1938 | Nelson | 68/134 |
| 2,150,654 | 3/1939 | Geldhof | 68/134 |
| 2,228,057 | 1/1941 | Kirby | 68/134 X |
| 2,230,006 | 1/1941 | Nelson | 68/134 X |
| 2,235,452 | 3/1941 | Kirby | 68/54 |
| 2,328,482 | 8/1943 | Nelson | 68/134 |
| 2,416,611 | 2/1947 | Castricone | 68/134 X |
| 2,471,760 | 5/1949 | Marsh | 68/134 |
| 2,642,733 | 6/1953 | McCormick et al. | 68/134 |
| 3,117,434 | 1/1964 | Byrd et al. | 68/134 |
| 3,285,040 | 11/1966 | Bochan | 68/134 |
| 3,307,383 | 3/1967 | Cobb et al. | 68/134 |
| 3,648,486 | 3/1972 | Rosinski et al. | 68/134 X |
| 3,987,651 | 10/1976 | Platt | 68/133 |
| 4,003,225 | 1/1977 | Worst | 68/18 FA |
| 4,018,067 | 4/1977 | Vona, Jr. et al. | 68/134 |

*Primary Examiner*—Philip R. Coe
*Attorney, Agent, or Firm*—Radford M. Reams

[57] ABSTRACT

A vane shape for producing optimum washing action in vertical axis clothes washing machines including vanes located in the bottom of the tub or basket and shaped with radially canted edges which cause the fabric articles to be pulled and slid outwardly as the edge is rotated into the articles to establish a toroidal circulation within the tub. In a preferred embodiment, an oscillated agitator is provided with a series of vane pairs joined at the lower side to form a V-shaped trough with either upper edge of the vane pairs inclined to produce a net outward movement of the washed articles by alternate engagement with a respective upper edge of either vane blades upon alternate rotation into the load. The vane shapes are either mounted to an oscillating agitator, a rotary impeller, or integrally formed in an oscillating basket. An arrangement for attenuating the action of the vane shapes is provided either by movable intermediate spoiler vanes or the combination of a reduced size vane agitator is used for gentle wash loads, with a slip-over agitator having vanes of normal size. Variations in the vane arrangement include asymmetrically sized vane pairs which balance torque variations in the agitator drive mechanism, and a snap-in lint filter occupying the space between vane pairs; additional radially extending vanes which augment the circulating effect by drawing the clothing articles downwardly along the agitator post and into engagement with the vane shapes; and a vane shape for agitators which simplifies molding of the agitator.

20 Claims, 20 Drawing Figures

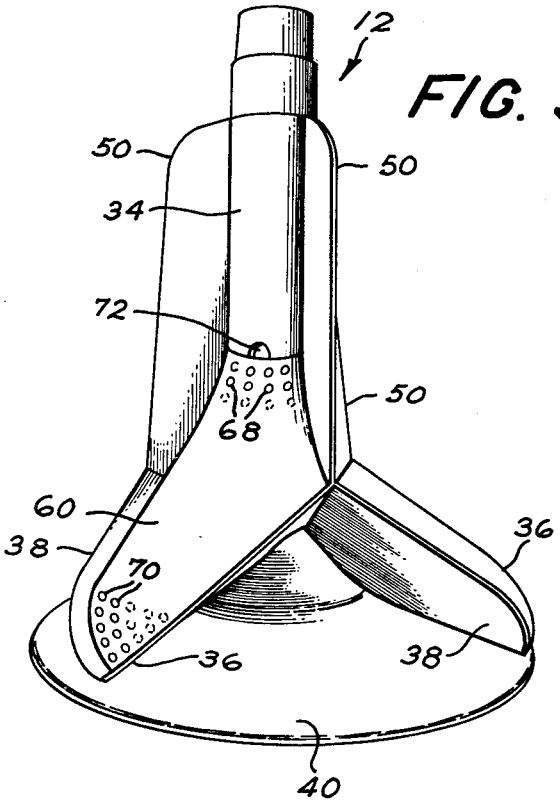
FIG. 9
FIG. 10
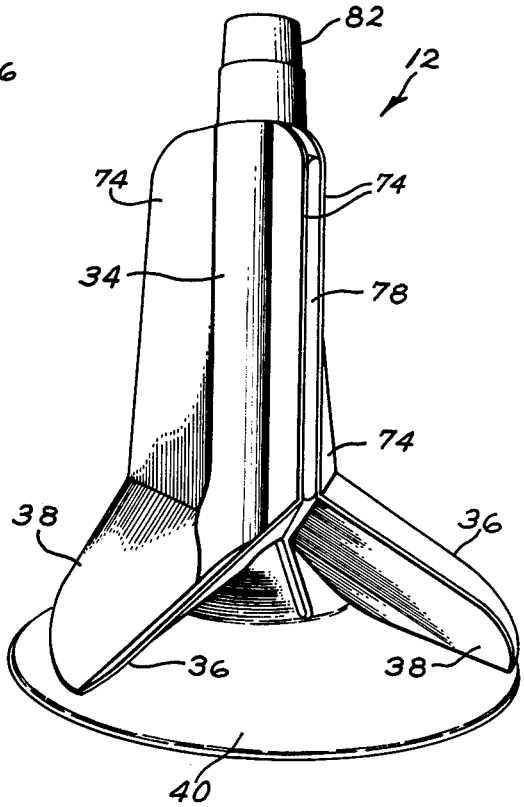
FIG. 11
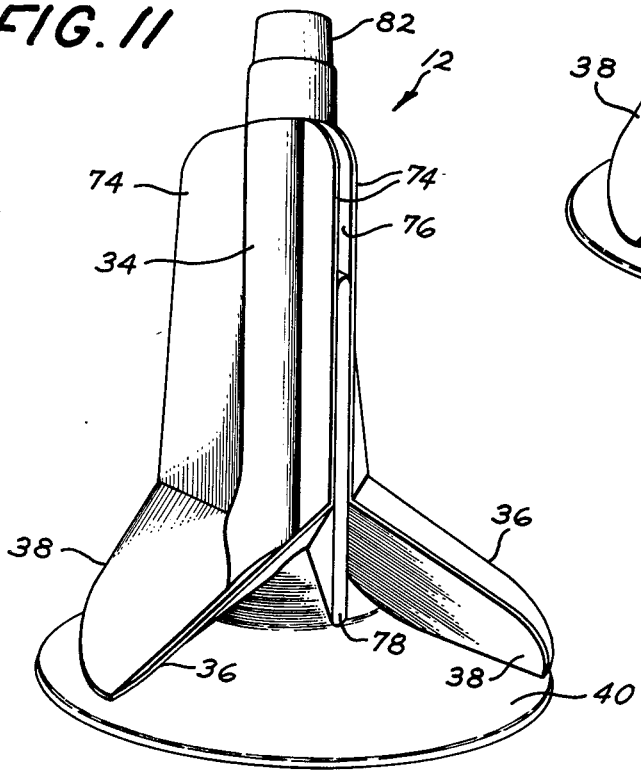

VANE ARRANGEMENT FOR CLOTHES WASHING MACHINE

BACKGROUND DISCUSSION

This invention concerns washing machines and more particularly vertical axis clothes washing machines of the type in which the washing action is achieved by agitation of the clothes-washing solution load.

In such washing machines, the agitation washing action is achieved by the resultant rubbing movement of the articles to be washed against other surfaces of the fabric or against the interior surfaces of the basket or agitator.

Accordingly, for effective and uniform washing action, all of the clothes surfaces should be evenly exposed to such rubbing action.

An additional feature of the agitator is to enable freeing of the dirt particles and scum to enable settling out to the lower region of the tub. Similarly, the circulation of the lint formed at the inner face of the edge of the clothes enables recirculation flow of wash water to filter out the lint particles during the wash cycle.

It has long been recognized that these requirements are very admirably met by a so-called toroidal circulatory movement of the clothing or other fabric articles to be washed, as discussed for example in U.S. Pat. Nos. 3,987,651; 4,018,067; and 3,285,040. Such toroidal circulation causes the articles to move downwardly along the agitator post (in those machines utilizing an agitator for the achievement of agitation) and thence outwardly along the receptacle bottom, up the basket sides and thence to the center region to complete the movement cycle. This achieves the proper uniform disposition of the article surfaces to the washing/rubbing action, reduces tangling, yields a smooth agitator action which reduces the drive torque requirements, and prevents excessive rubbing or pulling of the clothing surfaces.

The achievement of such toroidal movement has heretofore been primarily achieved by the establishment of a radially outward flow of the wash water in the lower region of the basket, this flow carrying with it the fabric articles. While satisfactory for relatively fluid clothes-water mixes, as the clothes load increases, the fluidity of the mixture decreases to the point where the mixture no longer behaves as a liquid and hydraulic forces available to circulate the articles are insufficient to establish the circulatory movement of the articles themselves. The load then tends to stagnate, causing excessive wear on some of the surfaces of the articles and deficient washing action on others.

Another difficulty encountered in such machines including an agitator with radially extending vanes to establish such water flow is the so-called chording action in which the clothing articles are drawn or pulled radially inward upon draping engagement with the edges of the radial vanes as the vane edges are advanced into the article. This radial inward movement defeats the toroidal circulation as well as sometimes causing the articles to be drawn beneath the clearance space between the agitator and the basket bottom, which can severely degrade the fabric material.

To overcome such difficulties, it has heretofore been proposed to augment or supplant the water circulation systems with an agitator action causing movement of the clothing articles in a proper direction by direct contact of the agitator with the clothing articles. These designs have involved relatively complex and costly structures which increase significantly the cost of manufacturing the washing machine. The cost of such machines is a critical factor in a highly competitive market and this increase in cost is a very substantial drawback.

It is accordingly an object of the present invention to provide an arrangement for establishing a toroidal circulation of clothing articles in clothes washing machines of the type described which is capable of establishing such toroidal flow with relatively lean water/-fabric ratios.

It is another object of the present invention to provide such an arrangement which is relatively simple and which does not substantially increase the cost of manufacturing the washing machines.

It is yet another object of the present invention to provide such an arrangement in which the tendency to chord the articles by rotation of the agitator vanes is substantially nullified.

SUMMARY OF THE INVENTION

These and other objects of the present invention, which will become apparent upon a reading of the following specification and claims, are accomplished by vane shapes mounted to a rotatable agitating member having a portion located in the bottom region of the fabric article receiving receptacle such as a tub or basket. The vane shapes include leading vane edges canted from the radial in a direction such that upon movement of the member into engagement with the clothes articles in a direction opposite from the direction of cant, the article are moved into draping engagement and ramped outwardly to establish the movement of the articles in a toroidal path within the receptacle.

In the preferred embodiment, the vane shapes are carried by the bell portion of an oscillated agitator with vane blades pairs joined along one side to be formed into a V-shaped trough extending generally radially and horizontally outwardly with the upper edge of each blade extending in a radially canted direction. The inclination of the vane blades from the vertical insures that draping engagement of either upper edge occurs only in the direction of movement of the agitator away from the cant of the respective vane edge. This in turn insures that only an outward pulling movement of the clothing articles is exerted by either of the respective edges by the oscillating motion of the agitator.

The relative blade size in each pair in one embodiment are made of differing size to compensate for the torque variations produced by the agitator drive mechanism.

The radially extending vanes extend upwardly along the agitator post and are positioned to define a channel aligned with the V-shaped trough to enhance the toroidal flow and insure untangled movement of the clothing articles. The radial fins serve to agitate the water in the upper levels of the tub and draw the clothing articles inwardly along the toroidal circulatory path. In one version, these radial vanes are configured to also induce a downward movement of the articles into engagement with the outwardly extending vane blade edges.

The V-shaped vane blade pairs are either undercut to maximize the "bite" of the leading blade edges into the clothes load or alternatively a vertical wall is disposed beneath the edge to enable simpler mold designs for fabricating the agitator.

The lower region of the troughs lying between the vane blades is optionally fit with a lint filter adapted to be snap fitted into the space and remove lint from the wash water as it circulates in the toroidal flow path between the radial and vane blades in order to reduce the bite of the vane blade upper edges.

Movable vanes are provided in some embodiments which are adapted to either be moved radially or axially into the face between the vane blade pairs to attenuate the action of the vane shapes.

In a variation of this, a gentle wash agitator having smaller vane blade sizes is adapted with a slip-over agitator configured with larger or normally-sized vane blades, formed with grooves in the space lying beneath each of the vane blades which receive the gentle wash agitator vanes. The vane shapes are also incorporated in alternated agitating devices including impellers having vanes formed with opposite leading edges radially canted to interact with the clothing articles during rotation in either direction of the impeller to pull the articles outwardly and establish the toroidal circulation.

In the oscillating basket design, a similar vane arrangement is formed in the bottom of the basket to similarly interact with the fabric items in the load.

DESCRIPTION OF THE DRAWINGS

FIG. 9 is a perspective view of an agitator having the vane design depicted in FIGS. 1 through 5 with the additional provision of a lint filter plate.

FIG. 10 is a perspective view of yet another variation of the agitator vane design depicted in FIGS. 1 through 5 incorporating an axially movable vane provided to reduce the action of the agitator vane design shown with the vane in the retracted position.

FIG. 11 is a perspective view of the agitator depicted in FIG. 10 with the axially movable spoiler vane shown in the operative position.

DETAILED DESCRIPTION

Figure 1:
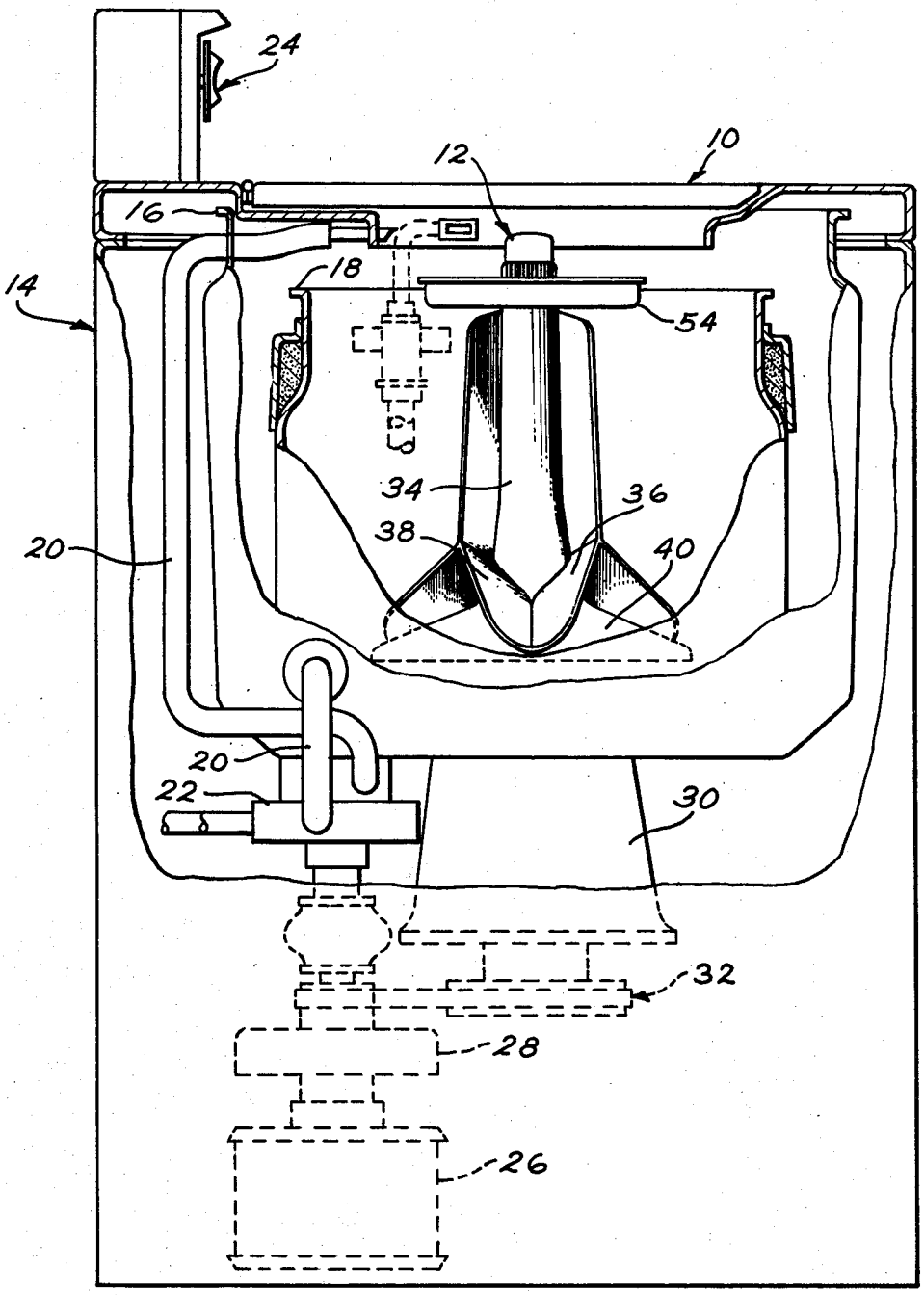
FIG. 1 is a side elevational view in a partial section of a clothes washing machine incorporationg an agitator having a vane design according to the present invention.
Figure 2:
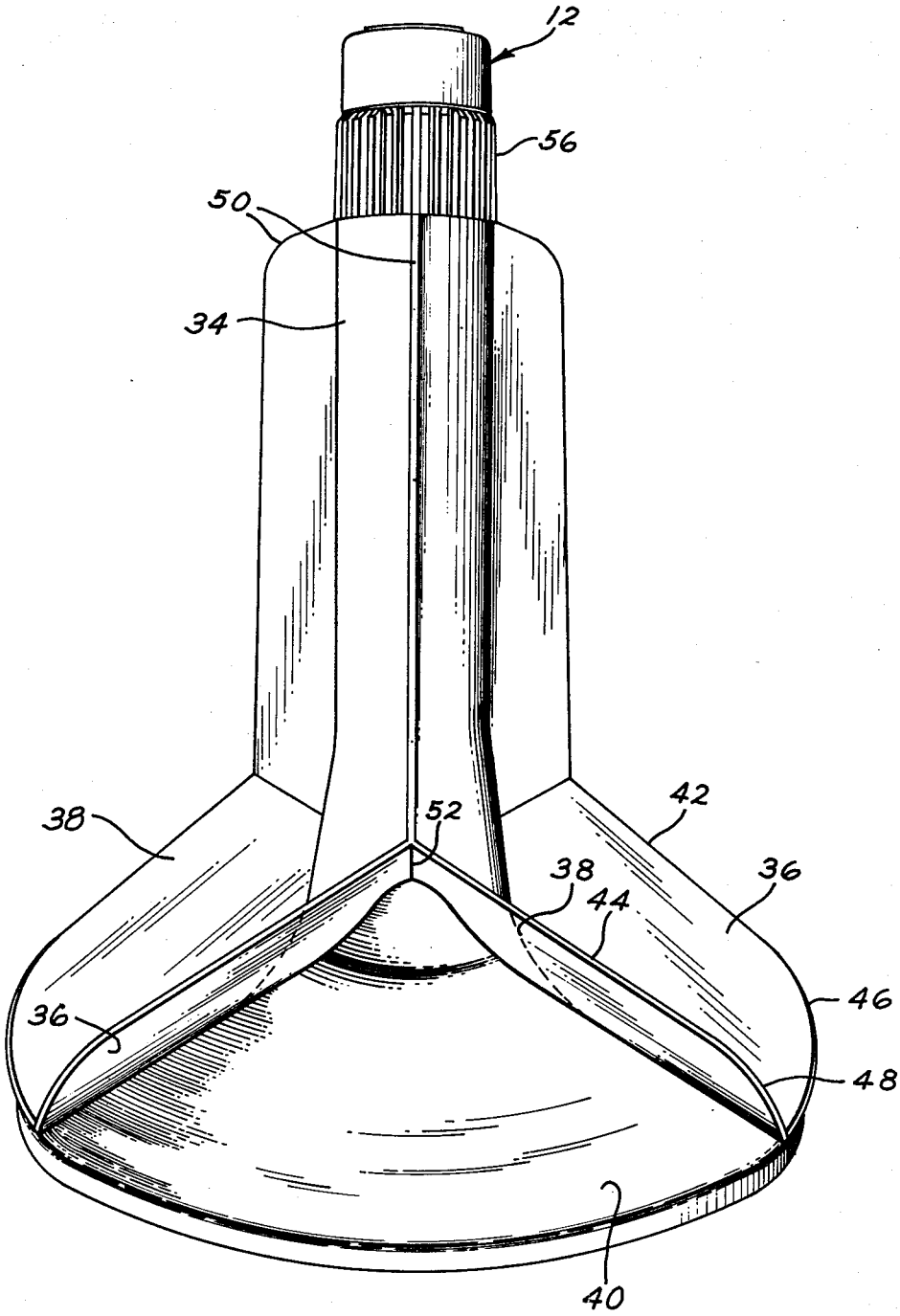
FIG. 2 is an enlarged perspective view of the agitator depicted in FIG. 1.

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

As discussed above, the typical arrangements producing the toroidal circulation of the fabric articles is the rotation of the vane surface within the article receiving receptacle such as a tub or basket, with the outward movement of the fabric/water mixture created by a pump action tending to set up the proper turnover flow. The fabric articles themselves rest in a mass on top of the impeller or agitator vanes and cannot effectively be pushed outwardly in the immediate vicinity of the bottom of the tub or basket. This is since the fabric items tend to drape across the vanes and cannot be effectively pushed by the vane surfaces. In addition, the engagement of the fabric surfaces with the vanes tends to produce a chording action in which the trailing portions of the articles are pulled radially inward as the agitator rotates.

According to the concept of the present invention, the outward radial movement of the farbic items is achieved by providing vanes extending generally horizontally and radially outward across the lower region of the basket, each having radially canted edges which lead during rotation of the agitator in either direction and which engage the fabric items upon rotation of the edges in a direction into the load and away from the cant of the edge, the fabric items are draped over the edge and pulled and slid radially outwardly by the ramping action of the vane edges. The net result is to effectively produce a net outward movement of the articles which does not depend on the existence of a fluid condition of the fabric/water mix and which overcomes the tendency to chord the trailing portions of the fabric articles.

In those instances in which the vane shapes are mounted on an oscillating element, such as an agitator which is rotated alternately in reverse directions, oppositely inclined vane edges are incorporated, one of which leads during rotation in either direction, each canted away from either direction of rotation undergone by the agitator. In order to insure that the fabric items are draped over the respective edges only in the proper direction of rotation to produce an outward sliding or pulling movement, the vane shape includes inclined-from-the-vertical, predominantly horizontal surfaces on the trailing side of the vane edge, with a vertical clearance on the other side to define a leading edge. Thus, each edge bites into the fabric only in the one direction of movement of the agitator in which the edge is leading the rotative movement. Outward sliding movement of the articles thus occurs in both directions to produce a net outward radial movement.

The degree of radial cant must be adequate to overcome the countereffects of chording of the fabric aticles and to set up an appropriate rate of movement for proper toroidal movement of the load. Accordingly, very slight angles of radial cant would normally not be sufficient, but some significant cant (i.e., greater than 5°) is required to meet these conditions.

Referring to FIG. 1, a vertical axis fabric article washer 10 is depicted in side elevation, with the outer cabinetry, tub and basket broken away to show an agitator 12 upon which is mounted a vane arrangement according to the above concept.

The washer 10 includes the outer cabinetry 14 which houses and mounts the various necessary components for carrying out the washing action of a fabric load. Such components typically include an outer tub 16 which is mounted to be relatively stationary and within which is mounted a clothes receiving receptacle comprised of a perforate basket 18. The basket 18 is the receptacle within which the fabric articles to be washed are received and in which the washing and rinsing action is carried out.

The basket 18 is spun to centrifugally extract the wash and rinse water after each wash and rinse cycle collected in the tub 16, in the manner well known in the art.

Arrangements are provided for filling, emptying and circulating of the wash and rinse water via hoses 20 and pump 22. Suitable washing machine controls generally indicated at 24 are also provided for the various wash and rinse cycles.

The agitator 12 is adapted to be driven by the machine drive motor 26, a two-speed clutch 28 in turn driving the transmission 30 via a belt drive 32, driven by the output of the two-speed clutch 28. The transmission 30 in conventional designs serves to produce oscillation of the agitator 12 by the electric drive motor 26 at a relatively low speed and upon reversal of the electric drive motor 26, the two-speed clutch 28 and transmission 30 produce relatively high speed rotation of the basket 18 for centrifugal extraction of the water from the load. Since these components are of conventional design and are well known to those skilled in the art, a detailed discussion of the same is not here included.

The agitator 12 includes an agitator post 34 located on the axis of oscillation and a radially extending agitator bell 40 is located in the bottom region of the basket 18. The vane arrangement includes shallowly inclined converging vane blades 36 and 38 which extend generally radially outward from the axis of the agitator 12 on the upper surface of the agitator bell 40.

Figure 3:
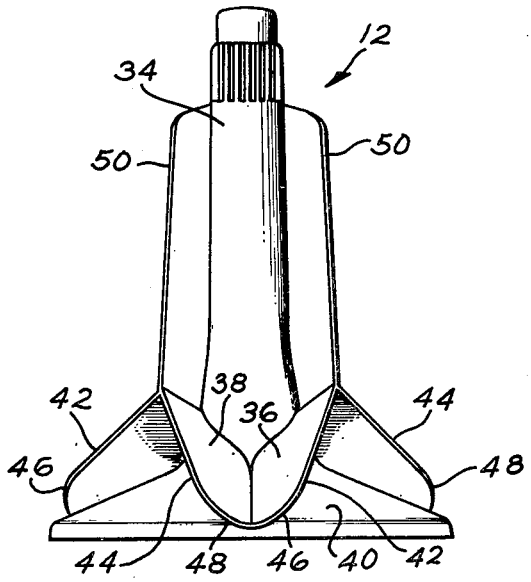
FIG. 3 is a side elevational view of the agitator element shown in FIGS. 1 and 2 in a direction aligned with one of the vane blade pairs.
Figure 5:
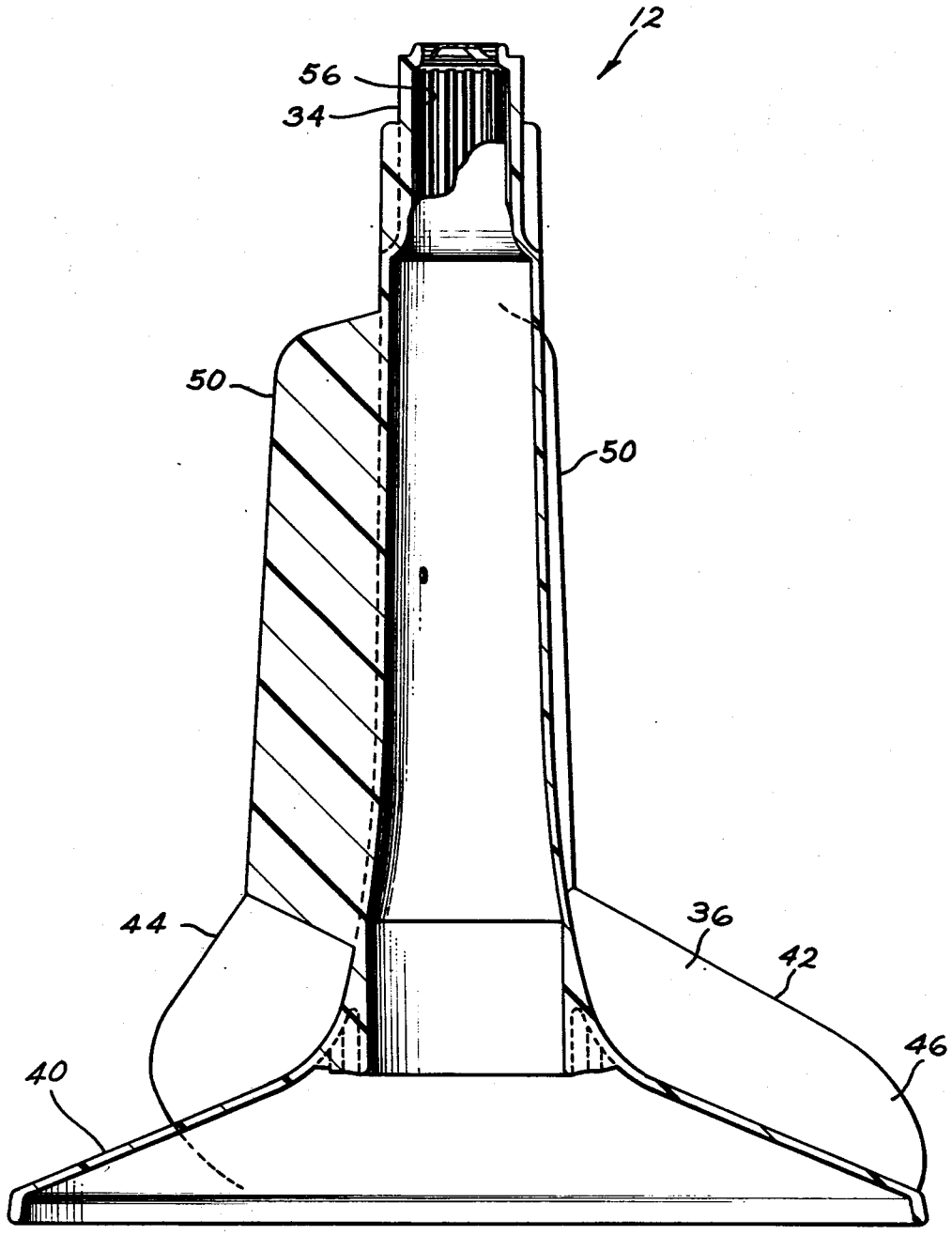
FIG. 5 is a sectional view of the agitator shown in FIG. 4 taken along the lines A—A in FIG. 4.

In the particular embodiment depicted, three sets of vane blade pairs 36 and 38 are provided equally spaced about the axis of the agitator 12. Each of the vane blade pairs 36 and 38 converges with each other, joined along either lower sides with the agitator bell 40. The upper edge of the vane blade pairs 36 and 38 extends, as best seen in FIG. 3, at a radially canted angle. That is, inclined from the radial direction with respect to the axis of rotation of the agitator 12.

The relative cant of the vane blades pairs 36 and 38 and the upper edges 42 and 44, respectively, is in a reverse direction with respect to each other.

Each of the upper edges 42 and 44 are rounded at 46 and 48 to blend into the agitator bell 40 outer perimeter. Each of the upper edges 42 and 44 is canted radially away from the direction of its inclination and the shallow inclination of each of the vane blade pairs 36 and 38 produces a unidirectional bite of the blade into the fabric item. That is, as the blade is advanced in the direction of its inclination into the load, the vane edge leads the rotation such that the fabric is brought into draping engagement with either upper edge 42 or 44 to produce a frictional engagement therebetween.

The radial cant is away from the direction of movement to provide an outward pulling movement.

Figure 4:
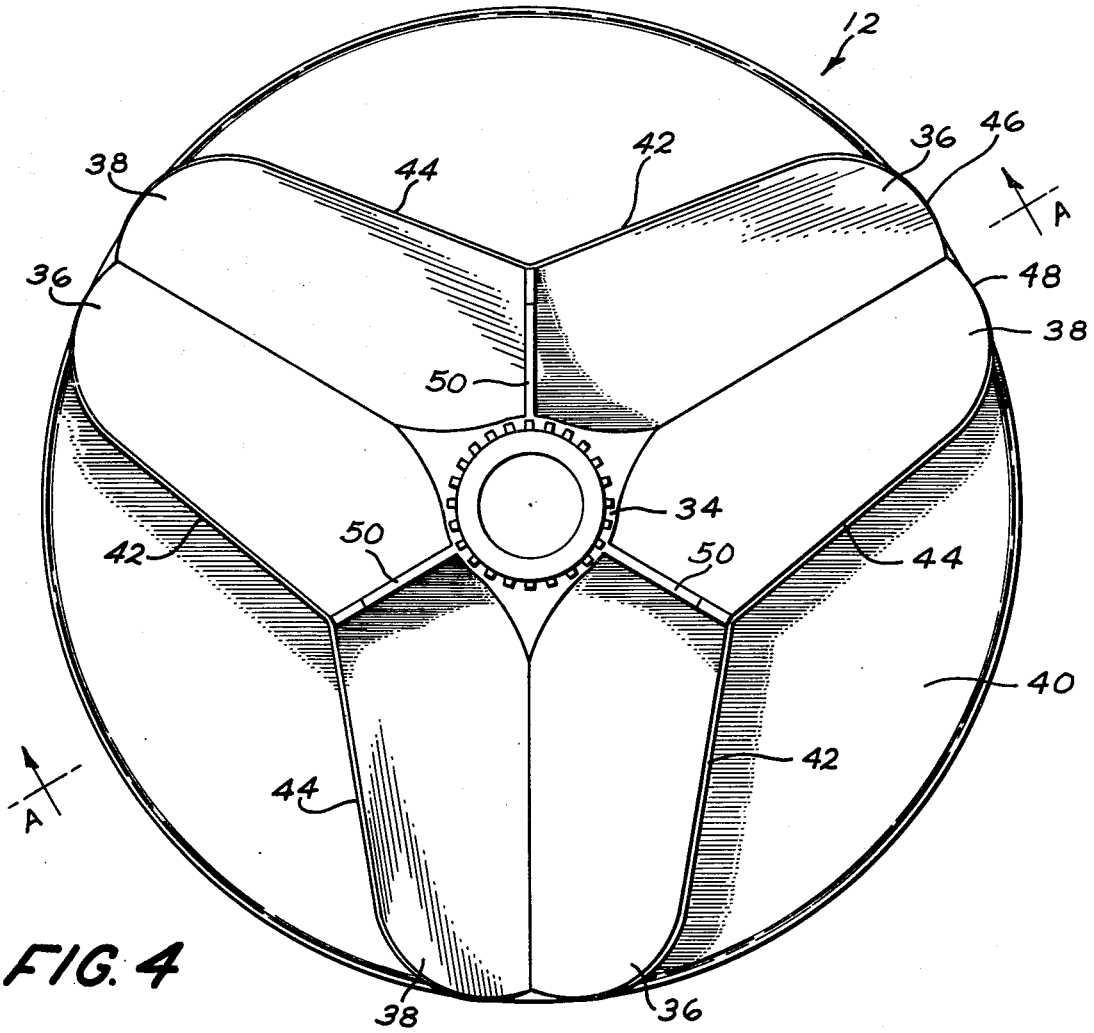
FIG. 4 is a plan view of the agitator element depicted in FIGS. 1 through 3.

That is, the relationship of the radial cant to the direction of rotation with the upper edge 42 or 44 leading is such that the axis of rotation of the agitator 12 is positioned behind the line of the leading upper edge 42 or 44. This can be seen by an examination of FIG. 4.

Upon movement in a reverse direction, the fabric items slide over the inclined from-the-vertical upper surface, which is predominantly horizontally extending such that the upper edges 42 and 44 cannot impose an appreciable force on the fabric items when the edge 42 or 44 trails the rotative motion of the agitator.

Thus, a net outward movement is produced by the upper edges 42 and 44 by oscillation of the agitator 12.

According to the preferred embodiment depicted in these FIGURES, the vane blade pairs 36 and 38 are located to converge at the point whereat they are joined with the agitator bell 40. This relationship creates a V-shaped trough which advantageously creates a channel for guided movement of the clothes radially outward. In addition, the agitator 12 is also provided with radial vanes 50 which extend axially along the length of the agitator post 34 and are aligned with the convergency of vane blade pairs 36 and 38 at their radial inmost root 52.

The radial vanes 50 are for the purpose of creating agitation of the water in the upper reaches of the basket and also serve to draw in the fabric items which are disposed in the upper region of the tub by the chording action described above. The space between each adjacent pair of the radial vanes 50 is thus aligned with the trough shape created by the space between the vane blade pairs 36 and 38 and thus provides an additional channel for movement of the fabric items in the upper regions of the tub to the outer region to augment the inducement of the toroidal circulation thereof.

The intersecting location of the radial vanes 50 and corresponding ones of vanes 36 and 38 also presents a relatively smooth surface as does the rounded corners 46 and 48 of the vane blade pairs 36 and 38, respectively, such as to provide the vane arrangement according to the present concept without crevices or sharp corners tending to snap or intrap the fabric articles.

The agitator 12 may also be provided with a filter pan 54, in the conventional designs, connected by means of a spline 56 formed on the upper end of the agitator post 34. The oscillatory drive to the agitator 12 is provided by a center shaft drive (not shown) mating with internal splines 56 formed in the upper end of the agitator post 34.

The agitator 12 is preferably molded from a suitable plastic resin which enables the agitator to exhibit sufficient strength characteristics while being able to be fabricated at a sufficiently low cost for use in the clothes washing machine.

Accordingly, as the agitator 12 is rotated in one direction, each of the respective leading edges 42 or 44 bite into the fabric articles draped over the respective vane edge 42 or 44 and causes the fabric items to be slid radially outwardly by the radial cant of those edges. Upon reversal of rotation, the same effect is achieved with the now leading edges 42 or 44 of the vane blade pairs 36 or 38 inclined away from the direction of rotation. The net result is an outward pulling and sliding movement of the fabric items which tends to establish toroidal flow.

This effect is augmented by the radial vanes 50 pulling in clothes in the upper region of the basket 18 and guiding them down into the trough space between the vane blade pairs 36 and 38 so as to become engaged with the vane edges 42 and 44 located in the lower region of the basket 18.

This effect, arising from mechanical engagement of the vane shapes with the fabric articles, does not depend on the existence of a fluid condition of the fabric/water mixture ratio and is effective for heavy wash loads or with the reduced water levels. The radial movement induced establishes the proper toroidal movement such as to provide uniform washing action on all surfaces of the fabric and avoiding excessive washing action on limited portions of the fabric. In addition, the tendency for the fabric items to be chorded so as to be pulled beneath the agitator bell 40 is substantially eliminated by the counter movements induced to thus reduce the incidence of fabric wear due to such occurrences.

Figure 6:
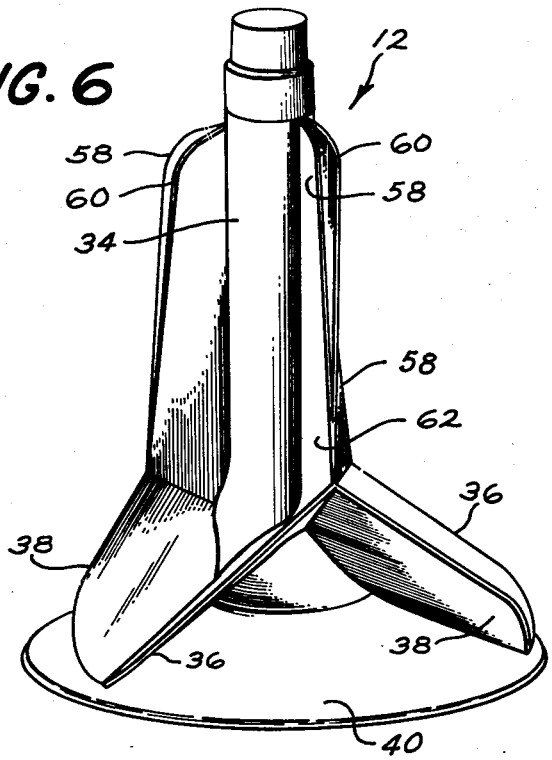
FIG. 6 is a perspective view of an alternate embodiment of the agitator shown in FIGS. 1 through 5.

The effect of the radial vanes 50 can be enhanced by providing a vane arrangement as shown in FIG. 6 by the provision of a series of vane pairs 58 and 60 which extend transversely to the radius of the agitator 12 and which are inclined outwardly along the axial length of the agitator 12 from top to bottom. Each of the vane pairs 58 and 60 are supported by a web 62. The combination of the radial slanting of the vane pairs 58 and 60 and the outward taper is such as to produce a downward ramping action on the fabric items such as they are drawn in and down in the intermediate space between the vane pairs 58 and 60 to augment the effect of gravity. This further enhances the effect of the overall vane agitator arrangement in establishing the toroidal flow.

The inclination of the vane blade pairs 36 and 38 establishes the proper torque level exerted on the load by the agitator 12.

In some designs, a pure sine wave motion is not impressed on the agitator, but rather distorts the wave. This distortion causes the relatively stationary basket which is contained in position by a brake snubber to be unevenly affected by the inertia of the load, such as to cause creep in one direction. This effect also has a tendency to cause the load to become tangled. Furthermore, the transmission mechanism tends to be more hightly stressed as a result of the unevenness of the movement.

The present vane design incorporating oppositely inclined vane blade pairs 36 and 38 affords the opportunity to eliminate these effects of the mechanism by evening out the reaction torque created by the agitator motion.

Figure 7:
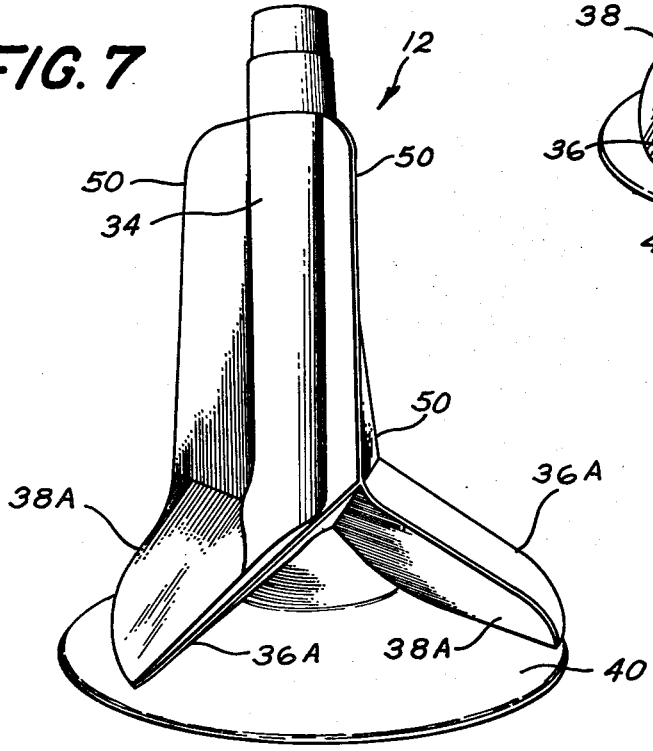
FIG. 7 is a perspective view of another embodiment of the agitator vane design shown in FIGS. 1 through 5.

This is depicted in FIG. 7 in which the vane blades 38A are larger than the vane blades 36A such that the reaction torque is increased upon oscillation in the direction in which vane blades 38A lead and is and decreased upon oscillation in the direction of rotation in which the vane blades 36A lead. The configuration of the vane blades 36 creates a relatively smaller torque reaction while the configuring of the blades 38 to be slightly larger relatively increases the torque reaction, to thus balance out the torque load impressed on the load and also on the transmission mechanism components.

Figure 8:
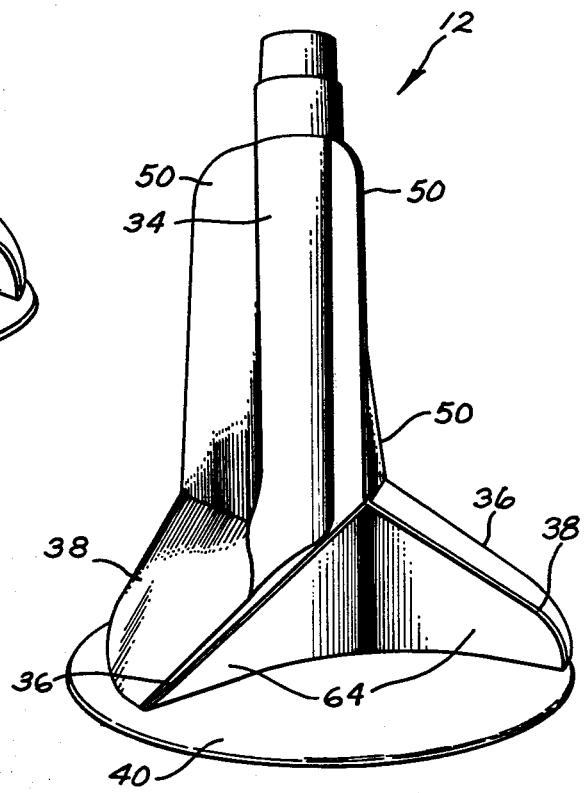
FIG. 8 is a perspective view of another embodiment of the agitator design depicted in FIGS. 1 through 5.

The undercutting of the vane blade pairs 36 and 38 provides a good "bite" of the blade by looped draping of the fabric items thereacross. On the other hand, the most usual fabrication technique for producing such components is by a molding process and the undercut would require a relatively complex mold configuration. As shown in FIG. 8, this disadvantage is overcome by providing webs 64 which extend vertically directly downwardly from the leading edges 42 and 44 of the vane blade pairs 36 and 38, respectively. While this reduces the "bite" somewhat, this does offer the advantage of simpler manufacturing techniques while still maintaining the vertical offset necessary for proper draping engagement.

The hollow between the vane blade pairs 36 and 38 can also be advantageously utilized to locate a filtering element as shown in FIG. 9. In this embodiment, a molded filter plate 66 is located in the space between one or more of the vane blade pairs 36 and 38. The filter plate 66 may be provided with hole series 68 and 70 at its upper and lower ends respectively as indicated in FIG. 9.

A snap fit within the radial blades 50 and the inclined vane blade pairs 36 and 38 maintains the filter plate 66 in position with a recess 72 provided in order to enable ready removal of the filter plate 66 for cleaning purposes. The circulation of the washing solution, being generally toroidal, is channeled between the radial vanes 50 and the vane blade pairs 36 and 38 such as to set up a circulatory flow through the filter plate 66. This will enable removal of the lint from the circulated flow, inasmuch as a large percentage of the lint is generated at the fabric agitator interface to collect the bulk of lint build-up during the agitation or rinse cycle.

It is often desirable to vary the agitation effect created by the agitator. That is, for relatively fragile items, the force exerted by the agitator on the fabric items in carrying out the washing action should desirably be reduced for fragile articles.

One arrangement for achieving this is depicted in FIGS. 10 and 11. This arrangement includes the provision of spaced pairs of radial vanes 74 rather than the single radial vanes 50, as in the above-described embodiment. Spacing of the radial vanes 74 provides an intermediate space 76 within which is located a vertically slidably spoiler vane 78 mounted in the space 76. In the retracted position, the lower edge 80 of the spoiler vane 78 is located above the intersection point of the vane blade pairs 36 and 38 between the alternate pairs as indicated in FIG. 10. The spoiler vane 78 is adapted to be positioned in a downward position by suitable adjustment mechanisms as by a threaded connection with the agitator cap 82, such that upon rotation of the cap 82 in one direction, the spoiler vane 78 descends into the space between the vane blade pairs 36 and 38 to be received into a recess 84 located in the agitator bell 40 as indicated in FIG. 11.

The presence of the protruding portion of the spoiler vane 78 partially nullifies the effect of the upper edges 42 and 44 since the fabric items are pushed away from the edges to the extent that the spoiler vanes 78 protrude radially.

Accordingly, the total agitator forces imposed on a load tending to set up a toroidal circulation are reduced proportionately.

Figure 12:
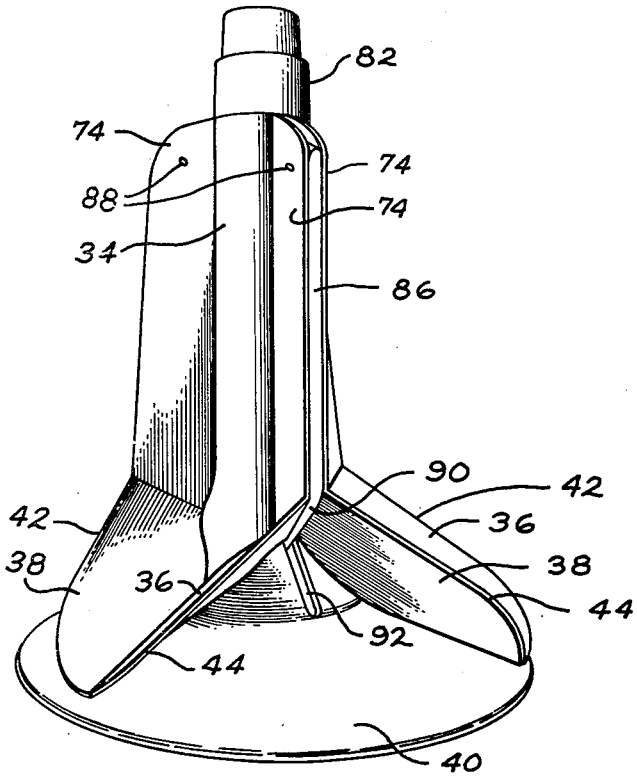
FIG. 12 is a perspective view of an agitator incorporating a variation of the spoiler vane in which it is mounted for pivotal movement in and out of cooperative engagement, showing the vane in the inoperative or retracted position.
Figure 13:
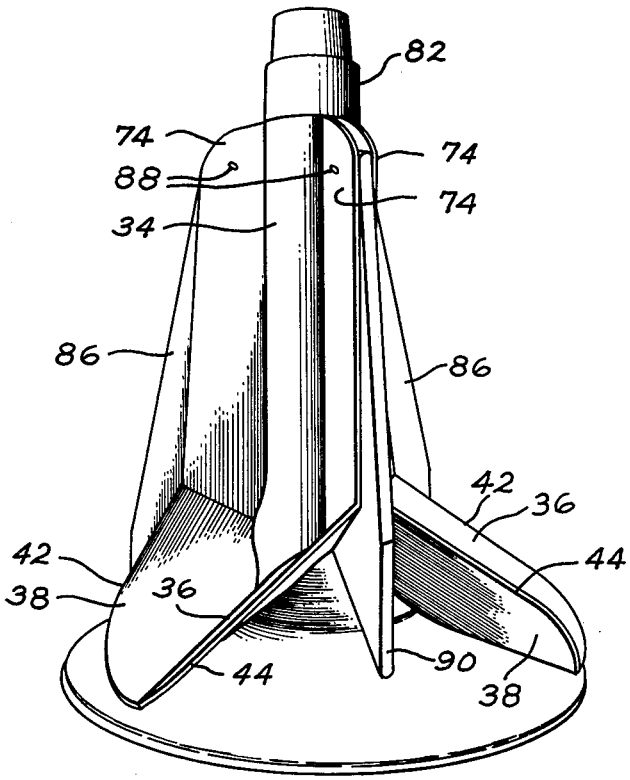
FIG. 13 is a perspective view of the agitator shown in FIG. 12 with the movable vane in the operative position.

An alternate arrangement is shown in FIGS. 12 and 13 in which pivotally mounted spoiler vanes 86 are provided which are pivoted at their upper ends at 88 and with the lower edges of the vane blades to be slanted at 90, such that in the retracted position shown in FIG. 12, the agitator vane configuration operates substantially the same as in the above-described embodiment of FIGS. 1 through 5.

A recess 92 is provided which allows the pivoting movement of the pivotally mounted spoiler vanes 86 to move into the intermediate space between the vane blade pairs 36 and 38 as shown in FIG. 13 to partially negate the effect afforded by the upper edges 42 and 44.

The radial movement of the spoiler vanes 86 may be provided by a mechanical motion induced by rotation of the cap 82 as in the above-described embodiment.

Figure 14:
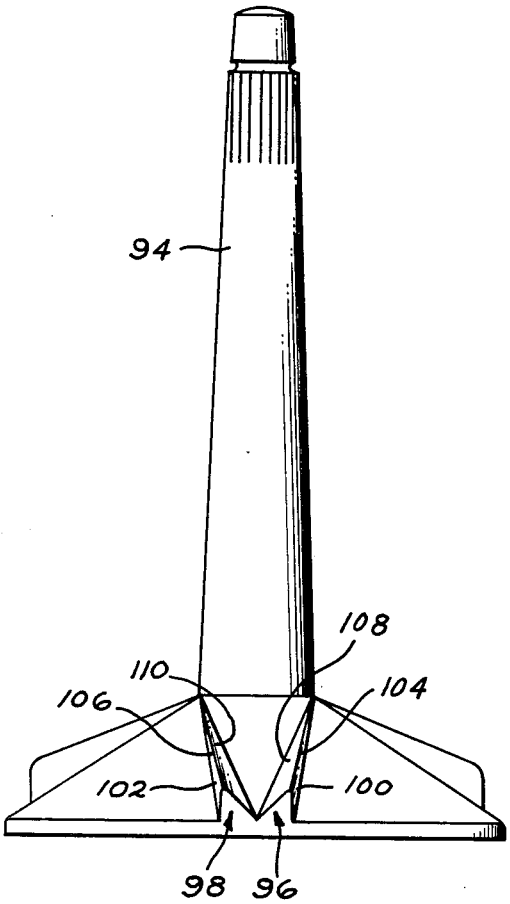
FIG. 14 is side elevational view of a gentle wash agitator configuration incorporating a reduced action vane design according to the design set forth in FIGS. 1 through 5.
Figure 15:
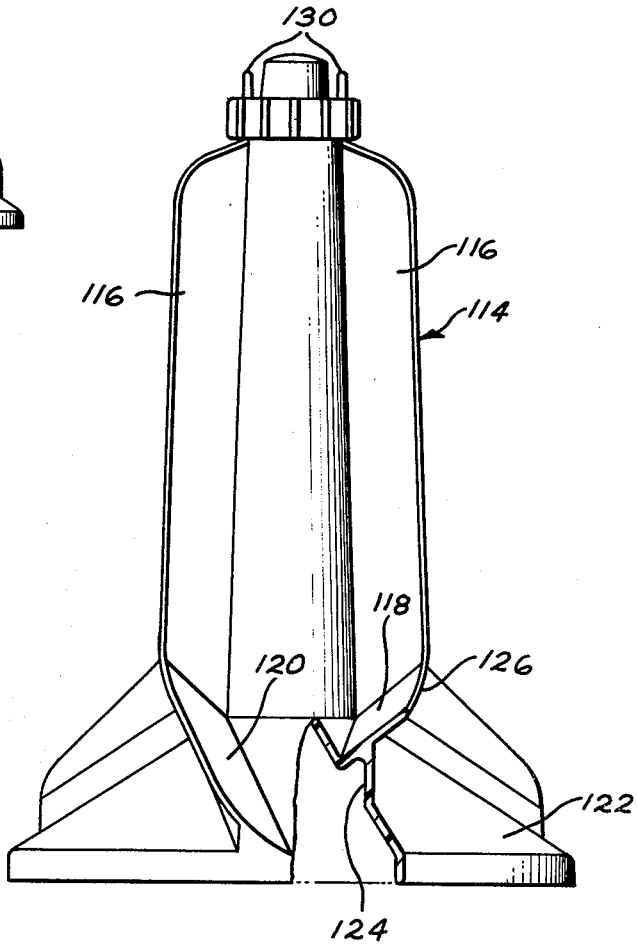
FIG. 15 is a side elevational view in partial section of a slip-over agitator adapted to be fit over the gentle wash agitator depicted in FIG. 14 in operative position to provide normal agitation action according to the concept of the invention depicted by the agitator of FIGS. 1 through 5.

Another approach is depicted in FIGS. 14 and 15. In this embodiment, a hand-wash agitator 94 is provided with vane shapes 96 and 98 of relatively smaller dimensions than in the above-described embodiments, and with sidewalls 100 and 102. In every other respect, the vane shapes 96 and 98 have the same configuration, i.e., having upper edges 104 and 106 which are radially canted and having upper surfaces 108 and 110 adjacent the side of the edges 104 and 106 in the direction of the radial cant. The blades would similarly be molded into the bell 112 of the hand-wash agitator 94. The reduced vane shape size would produce a much reduced slide-away action on the load to thereby reduce the washing action for fragile items.

A slip-over agitator 114 is provided in which the vane blades are sized in accordance with the requirements of the full normal washing action, including radial vanes 116 which are absent on the hand-wash agitator 94. The vane blades 118 and 120 are of a size more nearly conforming to the above-described embodiment and may be molded into the agitator bell 122.

The slip-over fit is provided by clearance comprised of a groove 124 formed in the underside of the respective vane blades 118 and 120 such as to provide a seating groove for the upper edges 104 and 106 of the vane shapes 96 and 98 of the hand-wash agitator 94.

The grooves are formed well inside the outer edges 126 and 128 of the vane blades 118 and 120 such that the substantial undercut is still provided. The location of the vane blades 96 and 98 is such as to be parallel to the inclination of the vane blades 118 and 120, but are spaced closer together such as to locate the grooves 124 at this point. It can be seen that this allows a nesting of the slip-over agitator 114 in such a way as to not effect the undercutting of the vane blades 118 and 120.

A locking arrangement is provided by pins 130 and insures the maintenance of the locking of the slip-over agitator 114 and the hand wash agitator 94.

Figure 16:
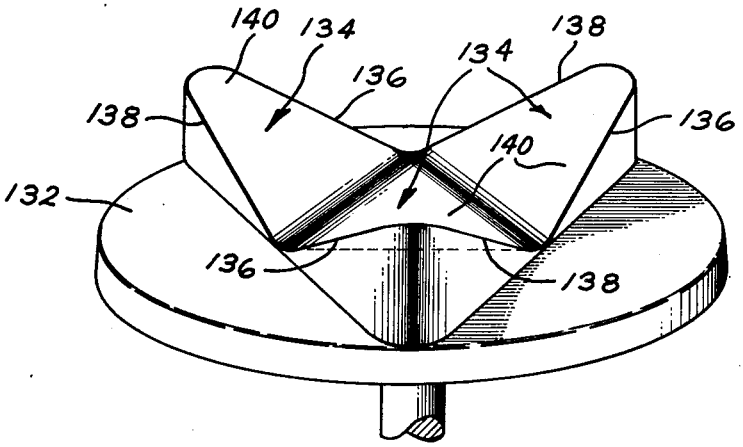
FIG. 16 is a perspective view of a rotating disc impeller incorporating the vane design according to the present invention.

The above discussion has been with reference to an alternate rotary component which is rotated alternately in reverse directions in each cycle in conjuction with the agitator. In some small load capacity machines, it has been known to provide an impeller pump to set up the centrifugal pumping action to circulate the load. In such designs, the impeller is rotated in a single direction, and is periodically reversed and run in the reverse direction. Similar vane blade geometry could advantageously be incorporated in such machines as depicted in FIG. 16 with an impeller disc 132 provided with a plurality of molded vanes comprising wedge-shaped impeller blades 134 having opposite edges 136 and 138 which tend to bite into the load in similar fashion to the agitator blade edges described above. The vane-shaped opposite edges 136 and 138 are radially canted in opposite directions. The vane-shaped opposite edges 136 and 138 are oriented with respect to an upper surface 140 which joins the edges 136 and 138 together. The orientation of the radial cant is such that it is toward the upper surface 140. Thus, fabric articles tend to be draped over the edges 136 and 138 which are leading in the particular direction of rotation opposite from the direction of the radial cant of such edges 136 or 138. Accordingly, one set of edges 136 or 138 will force the fabric items radially outwardly and upon reversal of rotation, the alternate radially canted edges 136 or 138 similarly force the fabric items outward. The presence of the upper surface 140 precludes the articles from draping over the edges 136 or 138 upon rotation in a direction toward the radial cant of the respective edge to produce unidirectional frictional engagement of the respective radially canted edges 136 or 138. Thus, as before, ramping of the article back upon reversal is prevented and a net outward movement is provided.

The surfaces 140 are also tilted so as to be inclined upwardly, as they extend radially outwardly to thus give somewhat of an upward forcing movement onto the fabric items.

Figure 17:
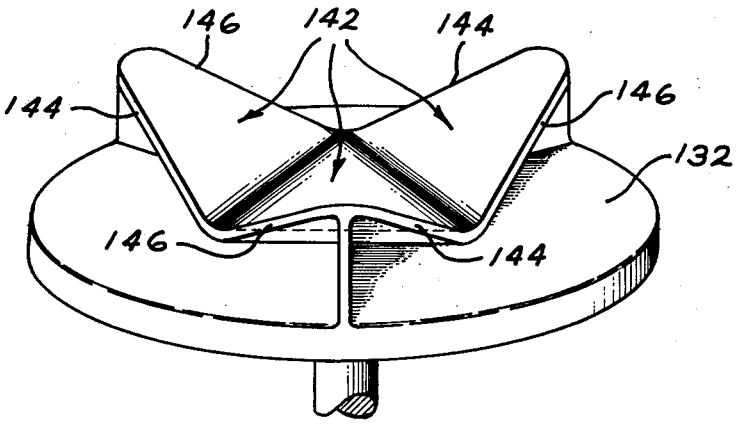
FIG. 17 is a perspective view of a rotating disc impeller having a differing version of the vane design depicted in FIG. 16.

A similar arrangement is shown on FIG. 17 in which instead of solid surfaces the vane shapes 142 are provided with undercuts to increase the drape and hence the bite of the edges 144 and 146.

Figure 18:
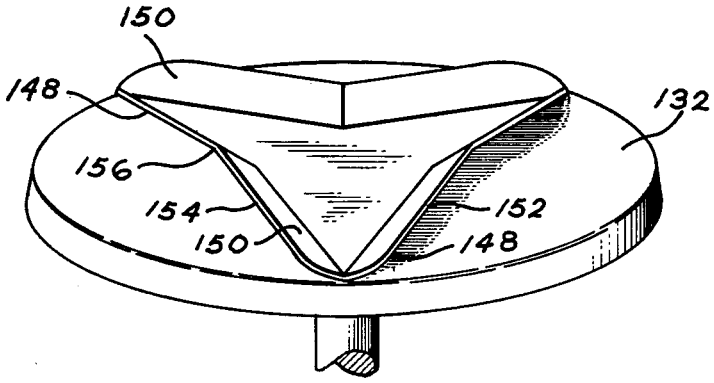
FIG. 18 shows a rotating disc impeller of yet another vane disc design.

Yet another version is depicted in FIG. 18 in which a V-shaped array of vane blades is provided including oppositely inclined vane blades 148 and 150 having upper edges 152 and 154 in similar fashion to the agitator version described above except that the vane blades 148 and 150 intersect each other at 156 to provide a structural support for the vane blade array.

Thus, the upper edges 152 and 154 are inclined and canted radially in similar fashion and juxtaposed to provide a trough-shaped intervening space. The inclination of the vane blades 148 and 150 provided increased bite of the edge in the directon of the inclination, the radial cant being away from the angle of inclination and provide a pulling/ sliding action on the fabric items to produce the net radial outward movement of the load.

Figure 19:
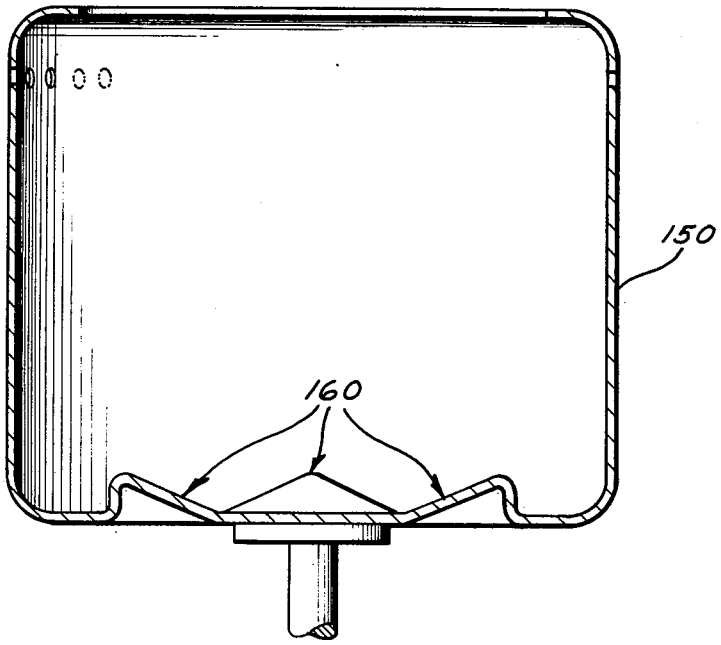
FIG. 19 is a clothes washing machine basket incorporating integral vane design in section taken along the lines B—B in FIG. 20.
Figure 20:
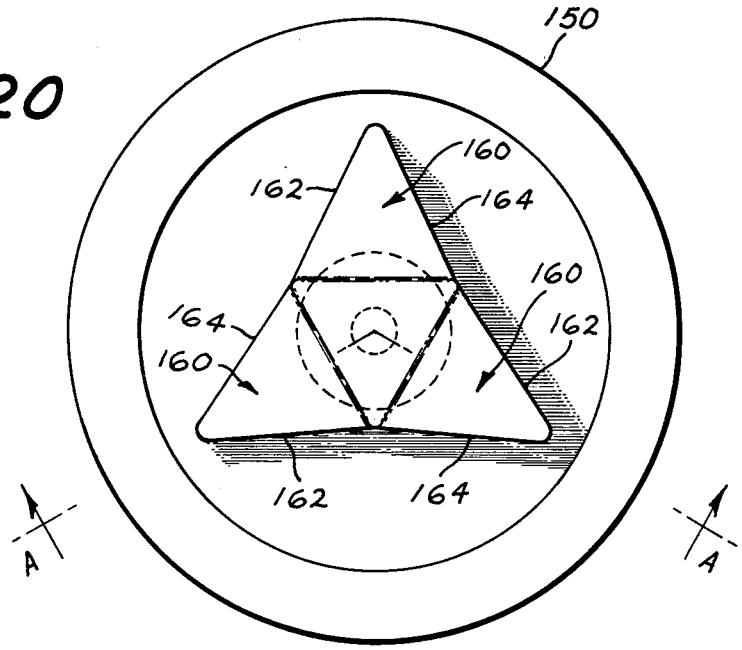
FIG. 20 is a plan view of the basket depicted in FIG. 19.

Finally in FIGS. 19 and 20, there is depicted the incorporation of the vane design into an oscillating basket. In some washing machine designs, the rotated member which sets up the washing action of the load may comprise the basket itself. In this case, the vane shapes 160 are incorporated in the bottom region of the basket 158, the vane shapes 160 formed integrally therewith. The vanes in this case are configured in similar fashion to that of the impeller depicted in FIG. 17, with radially canted edges 162 and 164 on either side of an upper surface 166.

Thus, as the basket is rotated a similar sliding action of the canted edges 162 and 164 with respect to the fabric items will be achieved.

In all of the above-described embodiments, the vane sets have been provided in three sets of opposed radially canted vane edges, since this is the most desirable in terms of torque loading and the washing action achieved.

It is to be understood, however, that any number will still achieve the basic effect described.

In addition, while the vanes have been described as being positioned in pairs, the oppositely radially canted edges may be related in other ways to each other, albeit this association has the favorable result in the context of the inclined blade version, as defining a trough to channelize the movement of the fabric items, which is highly desirable in this context.

Accordingly, it can be appreciated that the objects of the present invention have been achieved by this arrangement. That is, the movement of the fabric items radially outward does not require the fluid ratio of the water/clothes items, since it does not depend on a hydraulic pumping action, but rather acts on the fabric items in a mechanical way by pulling the items radially outwardly by the ramping action of the edges such as to nullify the effects of chording and to establish an outward circulation of the fabric items.

This result is achieved by a structure which is relatively simple and compatible to manufacturing techniques employed in the appliance industry and which does not entail an expense item inconsistent with the requirements of mass marketing of major appliances. This thus allows the use of relatively lean mixtures of the clothing items and the water, both for maximum load situations and for water savings.

The embodiments of the invention in which an exclusive property or privilege is claimed are defined as follows:

1. In combination with a vertical axis washing machine of the type including a fabric item receiving receptacle means, means for introducing a wash solution into said receptacle, and means for agitating the wash solution-fabric item load, said means including a rotatable wash load agitating member and means for rotating said agitating member about an axis, alternately in one direction and the opposite direction, said agitating member having a portion thereof located in the lower region of said receptacle to come into contact with said fabric item load in the lower region of said receptacle;

a vane arrangement carried by said agitating member portion comprised of at least one vane shape having a vane edge leading with respect to said one direction of rotation of said agitating member and extending generally horizontally through said lower region in a radially canted direction with respect to said axis of rotation of said agitating member and further having a surface adjacent the trailing side of said vane edge with respect to said one direction of rotation of said agitating member, said surface inclined from the vertical, whereby a draping engagement of fabric items with said vane edge is produced upon rotation of said agitating member in said direction;

said direction of radial cant being such as to locate said axis of rotation behind the line of said vane edge as said vane edge leads said rotative movement of said agitating member into said load, said vane arrangement further including at least one other vane shape, said at least one other vane shape having a vane edge leading with respect to said opposite direction of rotation of said agitating member and extending along a radially canted direction, said at least one other vane shape further including a surface adjacent the trailing side of said one other vane shape vane edge with rotation of said agitating member in said opposite direction, said surface being inclined from the vertical; said direction of radial cant of said one other vane shape vane edge being such as to locate said axis of rotation behind the line of said one other vane shape vane edge as said one other vane shape vane edge leads said rotative movement of said agitating member into said load;

whereby fabric items in contact with said vane shapes are forced into draping engagement with said respective vane edges by said rotation in said one direction and said opposite direction, said vane edges acting on said fabric items during said alternate rotation in said one and said opposite directions to cause a radially outward ramping movement of said fabric items and a resultant circulating movement of said fabric items within said receptacle by said radially outward movement of said items in the lower region of said receptacle.

2. The washing machine according to claim 1 wherein said vane surface adjacent said vane edge is inclined to the horizontal, extending downwardly away from said edge.

3. The washing machine according to claim 1 wherein each of said at least one vane shape and said at least one other vane shape surfaces are inclined from the horizontal and extending downwardly away from the respective vane edges to have portions in juxtaposition and form a V-shaped trough, whereby said fabric items are guided radially outwardly by movement through said V-shaped trough.

4. The washing machine according to claim 3 wherein said agitating member is formed with a plurality of each of said at least one vane shape and said at least one other vane shape circumferentially spaced about the axis of rotation of said washing machine member.

5. The washing machine according to claim 4 wherein each of said plurality of said at least one vane shapes and said at least one other vane shapes comprise vane blade members, juxtaposed in pairs to form a plurality of said V-shaped troughs, whereby said leading of said vane edges is established by the undercut created by inclination of said vane blades.

6. The washing machine according to claim 5 wherein said means for alternately rotating said washing machine member in said one direction and the opposite direction imposes a greater torque on said agitating member in one direction of rotation than the other and wherein one of said vane blades in each of said vane blade pairs is inclined toward said one direction of rotation and is smaller than the other of said vane blades in each of said vane blade pairs, whereby the reaction torque is reduced in said one direction.

7. The washing machine according to claim 5 further including at least one perforated filter plate and means for mounting said at least one perforated filter plate between one of said vane pairs to occupy the space between said vane blade pair, whereby the washing solution circulation through said perforated filter plate provides a lint filtering action during said washing action.

8. The washing machine according to claim 5 further including a slip-over agitator having agitator post and bell portions configured to be received over said agitator post and said vane blade pairs, said slip-over agitator having vane blade pairs formed therein of a larger size than said vane blade pairs on said agitator, the underside of said slip-over agitator bell being configured to be received thereover in mating relationship with said vane blades.

9. The washing machine according to claim 8 wherein said vane blades of said agitator are undercut adjacent said vane edges and wherein said slip-over agitator bell underside is formed with grooves spaced intermediate the width of said vane blade pairs, whereby an undercut of said vane blades in the region of said slip-over edge may be maintained.

10. The washing machine according to claim 4 wherein said washing machine agitating member comprises an agitator having an agitator post and an agitator bell comprising said agitating member portion extending radially outward therefrom at the bottom of said agitator, and wherein said plurality of vane shapes are carried by said agitator bell and further including radially extending blades secured to said agitator post extending axially along the length thereof and wherein said radially extending blades are located intermediate each of said juxtaposed vane shape surfaces, whereby the intermediate space between said radial vanes and said V-shaped trough are aligned to provide a path of movement of said fabric items through said intermediate space between said radial vanes and said V-shaped trough.

11. The washing machine according to claim 1 wherein said washing machine agitating member comprises a washing machine basket also forming said receptacle means and wherein said means rotating said member rotates said washing machine basket to produce a washing action and wherein and said at least one other.

12. The washing machine according to claim 1 wherein said washing machine agitating member comprises an impeller mounted in the bottom region of said receptacle means and means for rotating said impeller and wherein said at least one vane shape and said at least one other vane shape are formed on said impeller.

13. The washing machine according to claim 12 wherein said impeller is formed with a plurality of said at least one vane shapes and at least one other vane shapes circumferentially spaced about the axis of rotation of said impeller.

14. The washing machine according to claim 13 wherein said vane shapes are provided by a plurality of wedge-shaped vane members carried by said impeller, whereby said adjacent surfaces on each of said vane surfaces are provided by the wedge-shaped surfaces of said vane member.

15. The washing machine according to claim 13 wherein said vane shapes are provided by vane blade pairs located with respect to each other to produce convergency thereof at the radially outermost portion of said vane blades, and wherein said vane blade pairs are oppositely inclined.

16. The washing machine according to claim 1 further including means selectively operable to at least partially nullify the draping engagement of said fabric items with said at least one shape vane edge, whereby said sliding action produced by rotation of said agitating member may be reduced.

17. The washing machine according to claim 16 wherein said means comprises a movable spoiler vane adjustable to be moved into a position opposite said at least one vane shape vane edge, whereby said movable spoiler vane reduces the length contact of said sliding fabric items with said at least one vane edge.

18. The washing machine according to claim 17 wherein said radial vane is pivotally mounted to be movable on said pivot into said position.

19. The washing machine according to claim 17 wherein said spoiler vane is axially configured to occupy a position opposite said at least one vane shape vane edge, whereby said interengagement of said fabric items with said vane edge is reduced.

20. The washing machine according to claim 1 wherein said washing machine rotated member comprises an agitator having a post portion extending along said axis of rotation and a bell comprising said agitating member portion and wherein said at least one and said at least one other vane shapes are carried by said agitator bell and further including at least one radially extending vane extending along said agitator post, and wherein said at least one radially extending vane is inclined with respect to said agitator post axis of rotation to extend radially outwardly therefrom from the top of said agitator post to said bell portion, whereby said at least one radial vane tends to force the fabric items in contact therewith downwardly upon rotation of said agitator.

* * * * *

UNITED STATES PATENT AND TRADEMARK OFFICE

CERTIFICATE OF CORRECTION

PATENT NO. : 4,207,760

DATED : June 17, 1980

INVENTOR(S) : John Bochan

It is certified that error appears in the above-identified patent and that said Letters Patent are hereby corrected as shown below:

Column 12, line 27, after "said" insert -- vane --.

Column 13, line 36, after "wherein" insert -- said at least one --.

Column 13, line 37, after "other" insert -- vane shapes are disposed in the bottom of said washing machine basket --.

Signed and Sealed this

*Sixteenth* Day of *September 1980*

[SEAL]

*Attest:*

SIDNEY A. DIAMOND

*Attesting Officer*

*Commissioner of Patents and Trademark*